US012054312B2

(12) United States Patent
Maroofian et al.

(10) Patent No.: US 12,054,312 B2
(45) Date of Patent: Aug. 6, 2024

(54) CAKE TRAY HAVING HAND HOLD RECESS

(71) Applicant: Pinnpack Packaging, LLC, Oxnard, CA (US)

(72) Inventors: Ira Maroofian, Oxnard, CA (US); Dean Brown, Oxnard, CA (US)

(73) Assignee: PINNPACK CAPITAL HOLDINGS, LLC, Oxnard, CA (US)

( * ) Notice: Subject to any disclaimer, the term of this patent is extended or adjusted under 35 U.S.C. 154(b) by 0 days.

(21) Appl. No.: 17/318,555

(22) Filed: May 12, 2021

(65) Prior Publication Data

US 2022/0363442 A1 Nov. 17, 2022

(51) Int. Cl.

| | |
|---|---|
| ***B65D 25/28*** | (2006.01) |
| ***B65D 1/34*** | (2006.01) |
| ***B65D 25/10*** | (2006.01) |
| ***B65D 85/36*** | (2006.01) |

(52) U.S. Cl.

CPC ..... *B65D 25/2897* (2013.01); *B65D 1/34* (2013.01); *B65D 25/103* (2013.01); *B65D 85/36* (2013.01); *B65D 2525/281* (2013.01); *B65D 2585/363* (2013.01)

(58) Field of Classification Search

CPC .. B65D 25/10; B65D 25/103; B65D 25/2857; B65D 43/0204; B65D 43/16; B65D 43/165; B65D 1/34; B65D 85/36; B65D 2525/281; B65D 2585/363; A47G 19/02; A47G 19/00; A47G 19/26; A47G 2400/061; A21D 13/80

See application file for complete search history.

(56) References Cited

U.S. PATENT DOCUMENTS

| | | | | |
|---|---|---|---|---|
| 6,513,675 | B1 * | 2/2003 | Brown | B65D 21/022 229/407 |
| 10,463,180 | B1 * | 11/2019 | Donnelly | A47G 19/02 |
| 2014/0262909 | A1 * | 9/2014 | Gartz | B65D 85/36 206/557 |
| 2019/0106270 | A1 * | 4/2019 | Phillips | B65D 85/36 |
| 2020/0060454 | A1 * | 2/2020 | Mazzola | A47G 19/26 |

* cited by examiner

*Primary Examiner* — Javier A Pagan
(74) *Attorney, Agent, or Firm* — Michael R Shevlin

(57) ABSTRACT

The invention is directed toward a cake tray that has a number of hand holding or gripping recesses for conveniently carrying the cake tray or base. The cake tray further include finger gripping recesses formed by upwardly projecting pads and protrusion.

18 Claims, 3 Drawing Sheets

CAKE TRAY HAVING HAND HOLD RECESS

CROSS REFERENCE TO RELATED APPLICATIONS

This application claims priority from U.S. Provisional Patent Application No. 63/022,900, filed on May 11, 2020, the contents of which are incorporated herein by reference.

FIELD

The present invention relates to a cake tray and, more particularly, to a cake tray having hand hold recesses for lifting and carrying the cake tray.

BACKGROUND

Cake trays are designed to safely transported the cakes. Typical cake trays usually include a base having cavities or recesses to hold the cakes and cover that are connected together. The cavities or recesses only prevent side-to-side movement in the cake tray. The bottom of cake trays are typically flat and difficult to pick up and carry.

It would be desirable to have a cake tray that can be lifted easily and carry the cakes without damage. It is with this need in mind that the present invention was developed.

SUMMARY OF THE INVENTION

Embodiments described herein may meet one or more of the needs identified above and may overcome one or more of the shortcomings of current trays. Various implementations of systems, methods, and devices within the scope of the appended claims each have several aspects, no single one of which is solely responsible for the desirable attributes described herein. Without limiting the scope of the appended claims, some prominent features are described herein.

The present application relates generally to a cake tray having one or more hand gripping recesses along the sides sized for a person's fingers. The cake tray may also have finger recesses formed by the underside of upwardly projecting pads and protrusions.

BRIEF DESCRIPTION OF THE DRAWINGS

The present embodiments may be understood from the following detailed description when read in conjunction with the accompanying figures. It is emphasized that the various features of the figures are not necessarily to scale. On the contrary, the dimensions of the various features may be arbitrarily expanded or reduced for clarity.

DETAILED DESCRIPTION

Embodiments of the invention will now be described with reference to the figures, wherein like numerals reflect like elements throughout. The terminology used in the description presented herein is not intended to be interpreted in any limited or restrictive way, simply because it is being utilized in conjunction with detailed description of certain specific embodiments of the invention. Furthermore, embodiments of the invention may include several novel features, no single one of which is solely responsible for its desirable attributes or which is essential to practicing the invention described herein.

Broadly, an embodiment of the present invention provides a cake tray that has a number of hand gripping recesses for conveniently carrying the tray. The cake tray further include finger gripping recesses formed by upwardly projecting pads and protrusion.

Figures 1A, 1B:
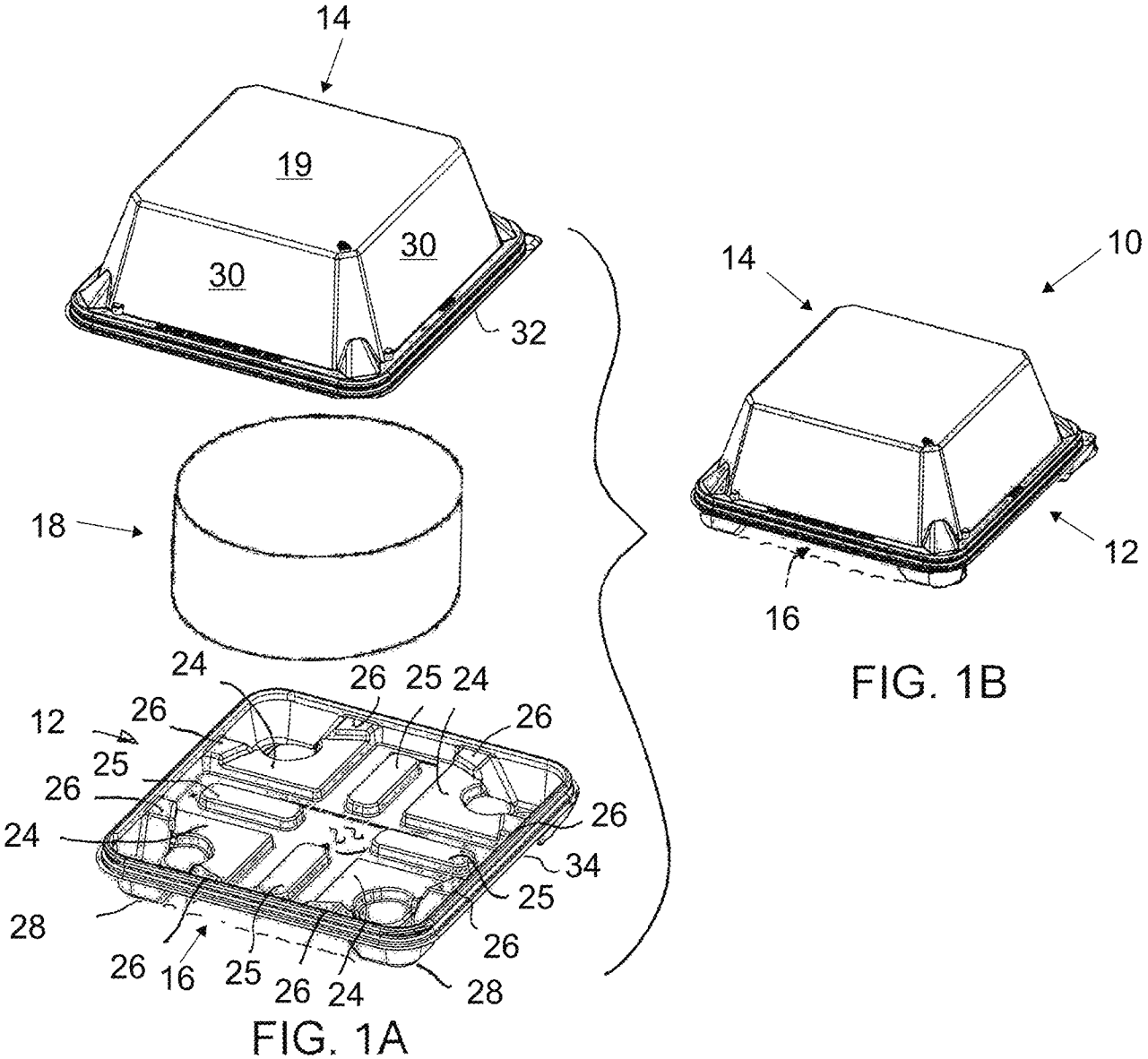
FIG. 1A is a perspective exploded view showing one embodiment of a cake tray.
FIG. 1B is a perspective view showing the embodiment of the cake tray in FIG. 2A with the lid on the base.

FIGS. 1A is a perspective exploded view and FIG. 1B is a perspective assembled view showing a cake tray 10 having a base 12 and a lid or top 14. The base 12 includes hand hold recesses 16 sized to fit a person's fingers for conveniently for carrying and transporting the cake tray 10.

The base 12 includes hand hold recesses 16 for carrying the cake tray 10. The base has a cake cavity 20 for holding the cake 18 having a bottom surface 22, multiple pads 24 extending upward from the bottom surface 22 configured to support a cake 18, and multiple feet or supports 28 near a perimeter of the base 12 extending downward from the bottom surface 22. The cake cavity 20 also includes multiple nubs or base retainers 26 for holding the cake 18 from sliding sideways.

The top or lid 14 includes a cake cavity 29 for covering the cake 16. The top or lid 14 includes a top surface 28 with sides 30 extending downward from top surface 28. The lower edge 32 of the sides are removably coupled with a lid engagement portion 34 of the base 12. While the cake tray 10 is shown as generally rectangular in the figures, it may be any shape, such as square, circle, triangle, star, hexagon, octagon, oval, or other suitable shapes. In some embodiments, the lid 14 is clear so that the cake may be seen. In some embodiments, the lid 14 may be opaque or be a solid color or pattern.

Figure 2:
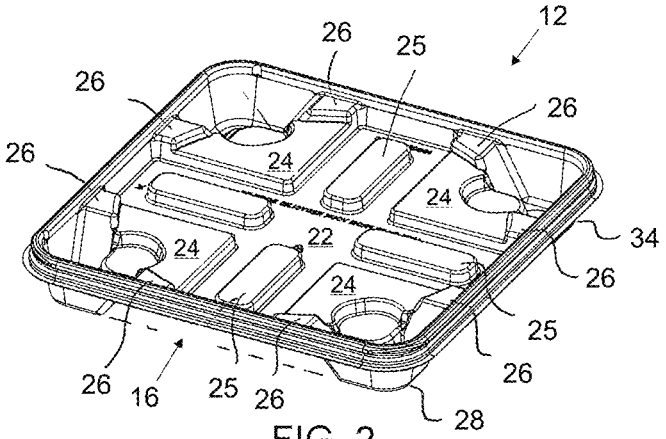
FIG. 2 is a perspective view of the tray base.
Figure 3:
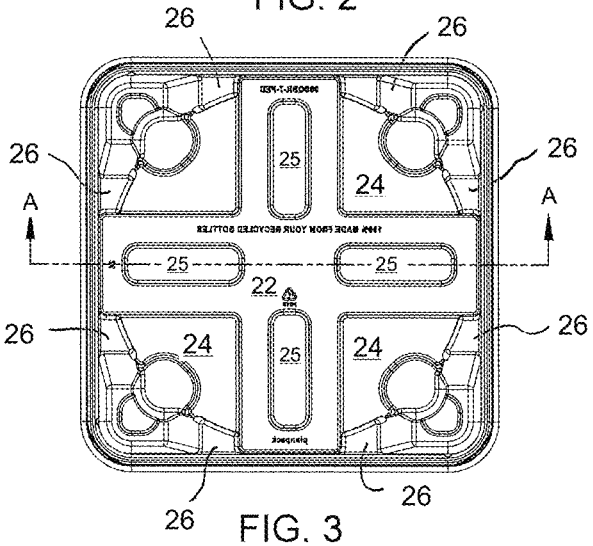
FIG. 3 is a top view of the tray base.
Figure 4:
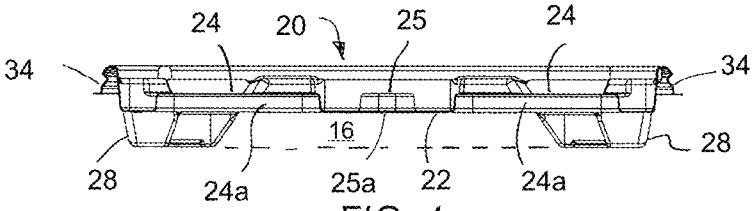
FIG. 4 is a cross-sectional side view A-A of FIG. 3 showing the tray base.

FIG. 2 is a perspective view; FIG. 3 is a top view; and FIG. 4 is a cross-sectional side view A-A of the base 12. In the embodiment shown, the base 12 includes the cake cavity 20 with bottom surface 22 having four pads 24 near the corners of the base 12 extending upward from the bottom surface 22. Each pad 24 includes two nubs or base retainers 26 around the outside edges of the cake cavity 20. The size and spacing of the nubs or base retainers 26 are configured to prevent the cake 18 from sliding sideways if the base 12 is tipped. The nubs or base retainers 26 may be formed integrally with the pads 24 or added in a secondary operation, such as with adhesive. The feet or supports 28 of the base 12 extend downward from the bottom surface 22 forming the hand hold recesses 16 sized to fit a person's fingers for conveniently for carrying and transporting the cake tray 10.

The base 12 may further include a series of upward projections or protrusions 25 from the bottom surface 22 positioned between the pads 24. The underside of the pads 24 and protrusions 25 form recesses 24*a*, 25*a*. The recesses 24*a*, 25*a* may provide grips for one or more fingers to securely carrying the base 12 or the cake tray 10. The protrusions 25 may further be configured to add stiffness or strength to the base 12.

Figure 5:
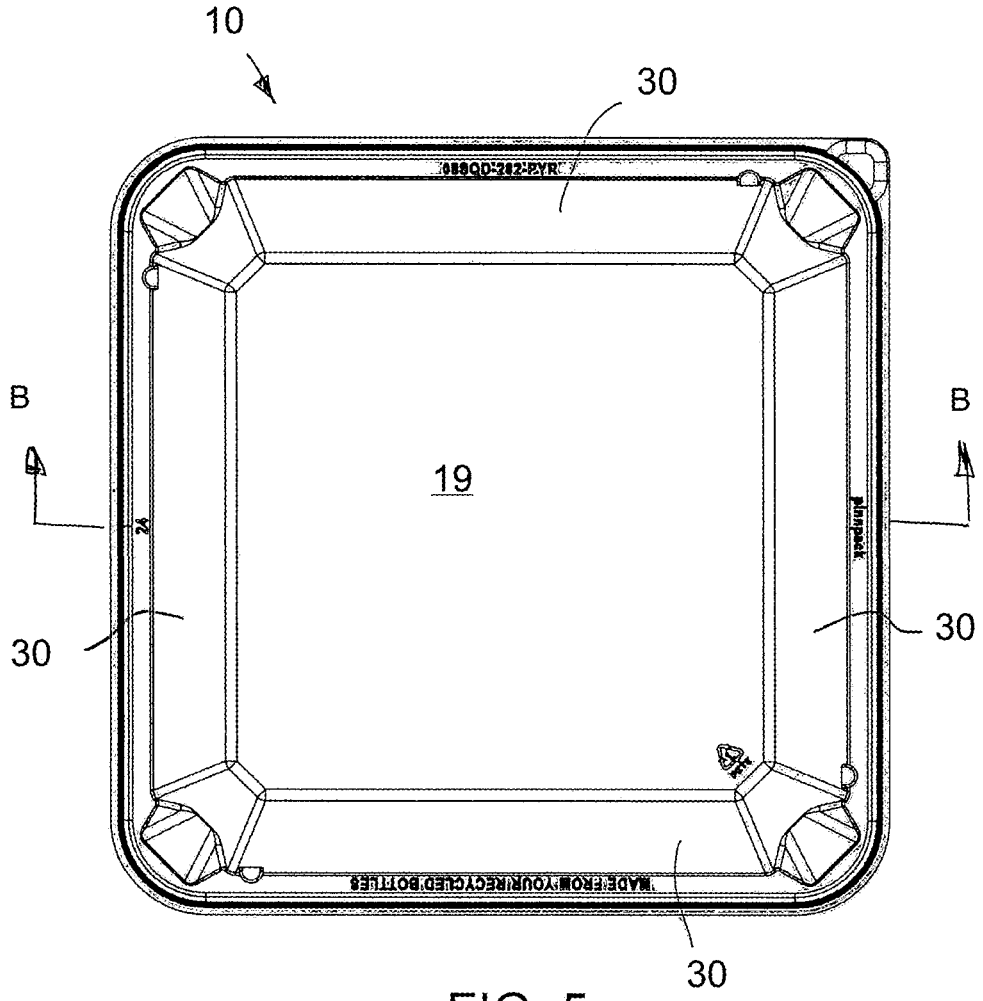
FIG. 5 is a top view of the cake tray.

FIG. 5 is a top view of the cake tray 10 with the base 12 and lid 14. The top surface 28 of the lid may be a single planar surface or can be provided with an indentation for strength, rigidity and/or aesthetics. In some embodiment, the top surface 28 may be used for labeling. In some embodiments, the lid 14 may be configured or sized to receive another cake tray 10 so that they may be stacked on top of each other.

Figure 6:
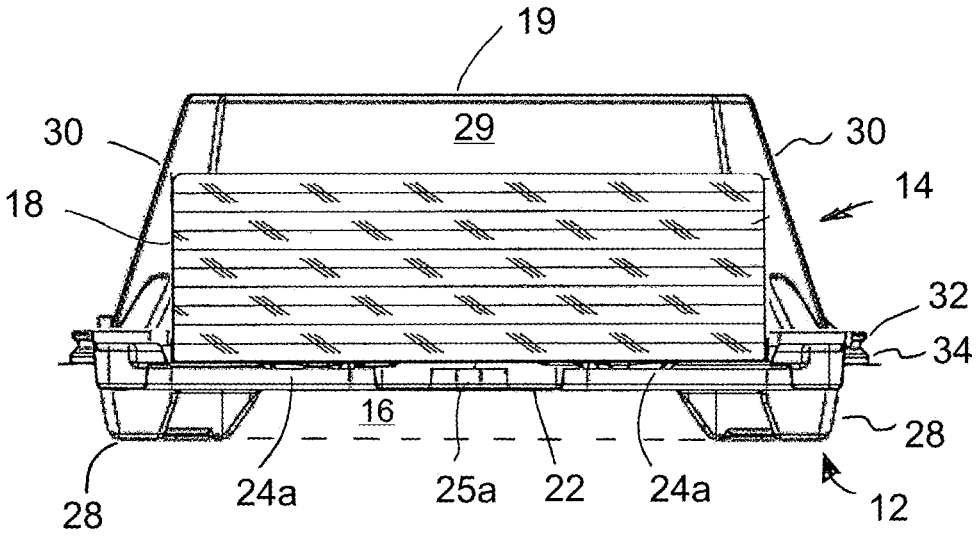
FIG. 6 is a cross-sectional side view at B-B of FIG. 5 showing the cake tray.

FIG. 6 is a sectional view at B-B of FIG. 5 showing the cake tray 10 holding a cake 18. As discussed above, the cake tray 10 includes a base 12 having a cake cavity 20 with bottom surface 22 having multiple pads 24 extending upward from the bottom surface 22 with multiple nubs or base retainers 26 around the edges of the cake cavity for holding the cake 18 from sliding sideways. The base 12 includes feet or supports 28 extending downward from the bottom surface 22 forming the hand hold recesses 16 sized to fit a person's fingers for conveniently for carrying and transporting the cake tray 10.

The top or lid 14 includes a cake cavity 29 covering the cake 18. The cavity 29 includes the top surface 28 with sides 30 extending downward from top surface 28. The lower edge 32 of the sides are removably couple with the lid engagement portion 34 of the base 12.

The various embodiments of the base 12 and lid 14 may be manufactured of any type of suitable plastic such as polystyrene or polyethylene, rubber, or any other suitable material. These materials may be opaque, clear or translucent, and the material of construction may be colored by pigments or any type of dye. The manufacturing techniques for making the base 12 and lid 14 may be any conventional method, including injection molding, blow molding, thermoforming or vacuum molding techniques.

While embodiments and applications of this invention have been shown and described, it would be apparent to those skilled in the art that many more modifications than mentioned above are possible without departing from the inventive concepts herein. It is to be understood that the present disclosure is illustrative only and that changes, variations, substitutions, modifications and equivalents will be readily apparent to one skilled in the art and that such may be made without departing from the spirit of the invention as defined by the following claims.

The invention claimed is:

1. A cake tray having hand hold recesses comprising:

a base having a cake cavity configured to hold a cake, the cake cavity includes a bottom surface having four pads extending upward from the bottom surface and four feet or supports extending downward from the bottom surface forming hand hold recesses positioned between the feet or supports;

a lid having a top and sides forming a top cake cavity, the sides having a lower portion configured to removably couple with a perimeter of the base; and finger gripping recesses formed by the underside of of the pads configured to receive one or more fingers while carrying the cake tray or base.

2. The cake tray of claim 1, wherein the pads are configured to support a cake.

3. The cake tray of claim 1, further includes a series of upward projections or protrusions positioned between the four pads.

4. The cake tray of claim 1, wherein each pad includes two nubs or base retainers extending upward near an outside edge of the cake cavity configured to prevent a cake from sliding sideways if the cake tray or base are tilted.

5. The cake tray of claim 1, wherein the base further includes a lid engagement portion around the perimeter of the base configured to removably couple with the lid engagement portion.

6. The cake tray of claim 1, wherein nubs or base retainers are formed integrally with the pads.

7. The cake tray of claim 1, wherein nubs or base retainers are added in a secondary operation, such as with adhesive.

8. A cake tray having hand hold recesses comprising:

a base having a cake cavity with a bottom surface configured to hold a cake including:

a bottom surface with four pads near the corners of the base extending upward from the bottom surface configured to support a cake;

two nubs or base retainers on each pad near the edge of the base configured to prevent a cake from sliding sideways if the cake tray or base is tilted; and four feet or supports near a perimeter of the base extending downward from the bottom surface forming hand hold recesses;

a lid having a top and sides forming a top cake cavity, the sides having a lower portion configured to removably couple with a perimeter of the base; and wherein the hand hold recesses are configured to receive one or more fingers while carrying the cake tray or base.

9. The cake tray of claim 8, wherein the hand hold recesses are positioned between the feet or supports.

10. The cake tray of claim 8, further includes a series of projections or protrusions extending upward from the bottom surface positioned between the pads.

11. The cake tray of claim 8, wherein the base further includes a lid engagement portion around the perimeter of the base configured to removably couple with the lid engagement portion.

12. The cake tray of claim 8, wherein nubs or base retainers are formed integrally with the pads.

13. The cake tray of claim 8, wherein nubs or base retainers are added in a secondary operation, such as with adhesive.

14. A cake tray having hand hold recesses comprising:

a base having:

a cake cavity configured to hold a cake having a bottom surface, four feet or supports near a perimeter of the base extending downward from the bottom surface, and four pads with two nubs or base retainers each extending upward from the bottom surface configured to support a cake and prevent the cake from sliding sideways if the cake tray or base are tilted;

a lid engagement portion around the perimeter of the base;

a lid having a top and sides forming a top cake cavity, the sides having a lower portion configured to removably couple with the lid engagement portion of the base; and hand hold recesses formed by the feet or supports configured to receive one or more fingers for carrying the cake tray or base.

15. The cake tray of claim 14, wherein the one or more hand hold recesses are positioned between the feet or supports.

16. The cake tray of claim 14, wherein the base further includes a series of projections or protrusions extending upward from the bottom surface positioned between the pads.

17. The cake tray of claim 14, wherein nubs or base retainers are formed integrally with the pads.

18. The cake tray of claim 14, wherein nubs or base retainers are added in a secondary operation, such as with adhesive.

* * * * *